US005785167A

United States Patent [19]

Rugg

[11] Patent Number: 5,785,167

[45] Date of Patent: Jul. 28, 1998

[54] ESCALATORS

[75] Inventor: Noel Andrew Rugg, Auckland, New Zealand

[73] Assignee: Escalator Advertising Limited, Auckland, New Zealand

[21] Appl. No.: 637,103

[22] Filed: Apr. 24, 1996

[30] Foreign Application Priority Data

Apr. 28, 1995 [NZ] New Zealand ..... 272019

[51] Int. Cl.[6] ..... B66B 23/12

[52] U.S. Cl. ..... 198/333; 198/502.1

[58] Field of Search ..... 198/333, 502.1

[56] References Cited

U.S. PATENT DOCUMENTS 5,176,239 1/1993 Findlay et al. ..... 198/333
5,411,127 5/1995 Findlay ..... 198/333
5,439,090 8/1995 Findlay ..... 198/333
5,441,140 8/1995 Reid ..... 198/333

FOREIGN PATENT DOCUMENTS 4314772 11/1993 Germany ..... 198/333

*Primary Examiner*—Joseph E. Valenza
*Attorney, Agent, or Firm*—Young & Thompson

[57] ABSTRACT

A device for displaying indicia on an escalator. The device includes a plate for attachment to an escalator step. The plate is of a transparent or translucent material and is shaped and arranged to complement the external profile of the step. The plate includes a front face and a back face, with an internal slot or space therebetween, into which a sign or other sheet material can be inserted and held.

5 Claims, 1 Drawing Sheet

ESCALATORS

FIELD OF THE INVENTION

This invention relates to the field of advertising, with particular application to means for providing indicia on an escalator or travelator.

PRIOR ART

International application PCT/GB92/01037 published under the Patent Cooperation Treaty WO92/22491 discloses a passenger conveying device having a plurality of interacting escalator steps, each step having a defined external profile allowing relative movement between adjacent steps wherein the steps have been modified for displaying indicia to a passenger on the steps. The indicia comprises a plurality of advertising signs on the riser (ie the vertical face of an escalator step) and/or tread (ie the horizontal surface of an escalator step) of the escalator. The sign is provided with a transparent cover which is positioned on the step so as not to interfere with the relative movement of adjacent steps on the escalator or the cyclic movement of the escalator itself. The cover has an external profile corresponding to the defined external profile of the steps.

A difficulty has been encountered with the above system, in correctly positioning the sign and holding it in place while the cover is fastened over it, particularly when removing one sign and replacing it with another.

OBJECT

It is an object of the present invention to go at least partway towards overcoming the above difficulty, or at least to provide the public with a useful choice.

STATEMENT OF INVENTION

In one aspect the present invention provides means for displaying indicia on a passenger conveying device such as an escalator or travelator, comprising a cover plate adapted and arranged for connection to a step of said device, said plate having an outer wall and an inner wall between which sheet material can be mounted in use.

Preferably at least one said wall is at least in part transparent or translucent.

Preferably the walls are parallel and preferably they are joined along at least one edge.

Alternatively the two parallel walls are joined by a plurality of fasteners.

In another aspect the present invention provides a method for displaying indicia on an escalator or travelator, including the steps of inserting an indicia-bearing sheet in a cover plate, and fastening said cover plate on a step of said escalator or travelator.

PREFERRED EMBODIMENT

Figure 1:
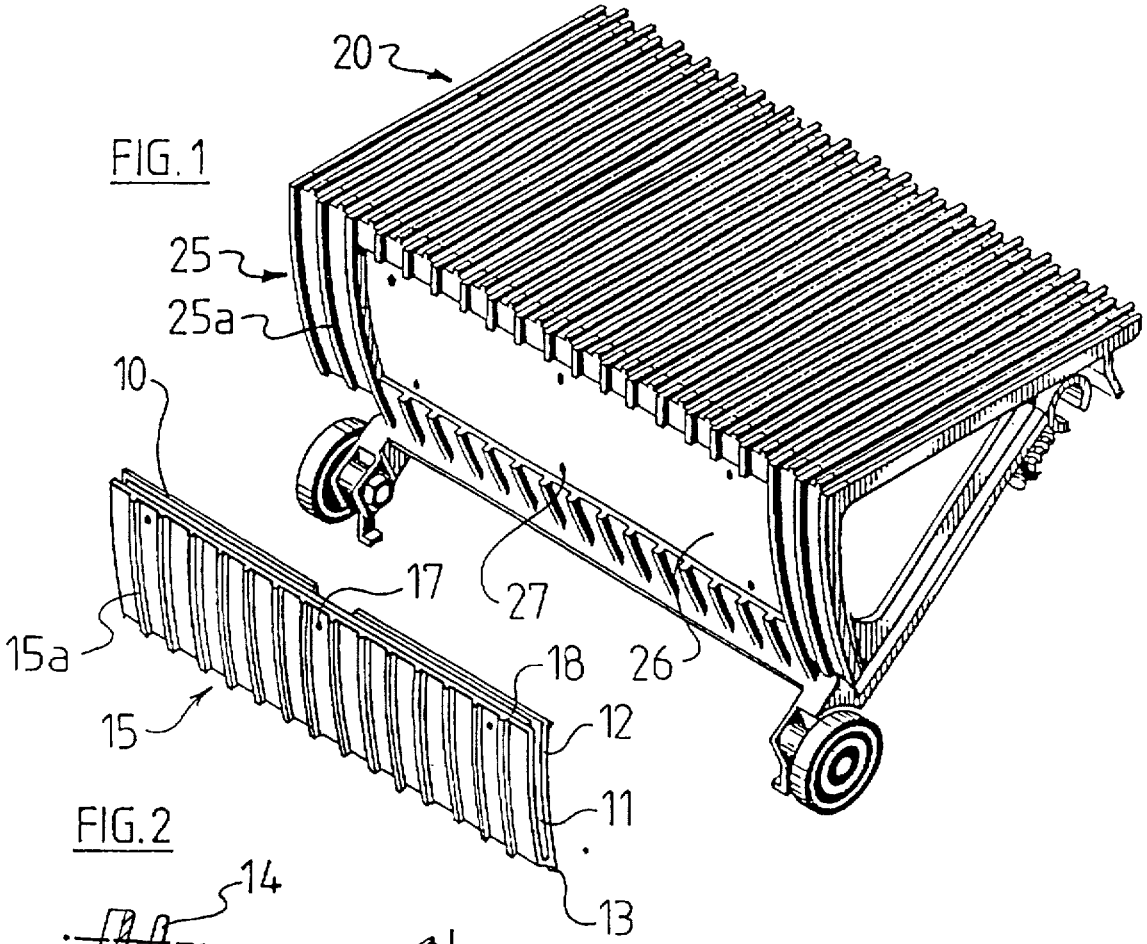

The following is a description of preferred forms of the present invention, given by way of example only, by which aspects and features of the present invention may be made apparent. It will be appreciated that a wide variety of changes and modifications might be made to these examples within the general spirit and scope of the invention. Reference is made to the accompanying drawings, in which:

FIG. 1: illustrates a preferred embodiment of the present invention in conjunction with an escalator step, in front perspective view.

Figure 2:
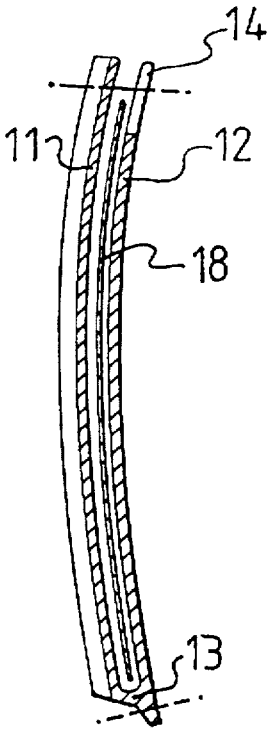

FIG. 2: illustrates the embodiment of FIG. 1 in side view and cross section.

Figure 3:
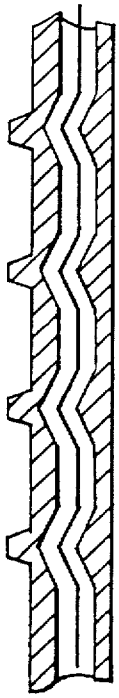

FIG. 3: illustrates detail of a second embodiment in plan view.

Figure 4:
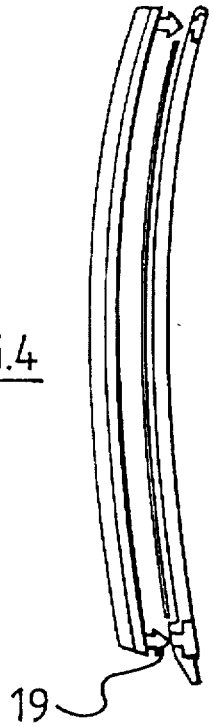

FIG. 4: illustrates the embodiment of FIG. 3 in side view and cross-section.

In its preferred form the present invention provides a cover plate 10 for mounting on the riser 25 of an escalator step 20. As shown, the riser 25 is provided with substantially vertical cleats 25A projecting from the front face, with a central recess 26 adapted to receive the cover plate 10. The cover plate 10 is shaped and arranged to fit into the recess 26, with cleats 15A on its front surface 15 matching those of the riser 25. The cover plate 10 is preferably formed of a transparent plastics material such as polycarbonate, and is fastened onto the riser 25 with a number of fasteners passing through corresponding apertures 17 and 27 in both. It will be appreciated that the number and arrangement of fasteners may be varied considerably, within the scope of the present invention.

As shown particularly in FIG. 2, the cover 10 is comprised of a front wall 11 and rear wall 12 joined along the base 13. A sign or other sheet material 18 can be mounted within the cover 10, between the front wall 11 and rear wall 12 as shown, resting on the base 13. The sheet material 18 may comprise a printed sign, advertisement or other indicia, or a decorative sheet of foil or other coloured material. A finger slot 14 may be provided in the rear wall 12 to facilitate removing and replacing the sheet material 18 in the cover 10. The side edges of the front and rear walls of the cover 10 are preferably not joined, so that in use they can be spread apart when sheet material 18 is being inserted between them, and then resiliently spring back together, to grip the material 18. By this means the sheet material can be pressed flat within the cover 10.

This arrangement allows signs or other sheet material to be mounted in the cover plate 10 prior to installation, thus avoiding difficulties and encumberance at the time of installation on site. Furthermore, the sheet material 18 is protected within the cover during transport to the site and during installation. It will be appreciated that escalator steps are often considerably soiled by pedestrian traffic, and also carry oil or grease on working surfaces. Unprotected sheet materials 18 can quite often be soiled or smudged in the process of installation. The present invention goes at least partway towards overcoming this problem.

A variety of alternative constructions are possible within the general spirit and scope of the present invention. In particular as shown in FIG. 3, the internal surfaces of the cover walls 11 and 12 may take a variety of complementary shapes, rather than simply comprising flat faces. As shown, the surfaces may be ribbed, so that the sheet material 18 follows the general contours of the cleated front face 15 of the cover plate 10. By this means, distortion of an image on the sheet material 18, caused by unequal refraction through the cleats 15A, may be reduced or compensated for. Other visual effects might similarly be achieved by altering the configuration of the sheet material 18 within the cover plate 10.

As shown in FIG. 4, the front wall 11 and rear wall 12 might be formed as separate elements, rather than a single integral construction. They may be joined at the base edge with a hinge, or as shown provided with snap-fit fasteners 19 by which they can be clipped together with the sheet material 18 between them. While the front wall 11 should be transparent or translucent, at least in part, the rear wall 12 could be opaque, and need not be formed from the same material as the front wall 11. This construction is considered less preferable than that described above with reference to FIGS. 1 and 2, because of potential difficulties in replacing or adjusting sheet materials 18 once they have been clipped into the cover plate 10, and the more complex assembly process required. Nonetheless, such constructions can be considered to fall within the general scope of the present invention.

A wide variety of other changes and modifications might similarly be made to the above examples, within the general spirit and scope of the present invention, which may be characterised as follows:

I claim:

1. A device for displaying indicia on a passenger conveyor, the device comprising: a cover plate adapted and arranged to be fitted as a cover on a riser of an escalator step and connected thereto, said plate having an outer wall and an inner wall, parallel to the outer wall and joined therewith along at least one edge, between which sheet material can be mounted in use, at least the outer wall of said cover plate being at least in part transparent or translucent.

2. The device for displaying indicia on a passenger conveying device as claimed in claim 1, wherein the means by which the two parallel walls are joined comprises a flexible and resilient connection, by which said walls are able to flexibly move apart, and resiliently move back together.

3. The device for displaying indicia on a passenger conveying device as claimed in claim 2, wherein said connection is integral with both said walls.

4. The device for displaying indicia on a passenger conveying device as claimed in claim 2, wherein said connection is comprised of at least two parts movably linked, one of each of parts being integral with each of said walls.

5. A method for displaying indicia on an escalator, comprising the following steps:

inserting, in a cover plate fitted and connected as a cover on a riser of an escalator step and having an outer wall and an inner wall parallel to the outer wall, and joined therewith along at least one edge, at least said outer wall being at least in part transparent or translucent, an indicia-bearing sheet between said outer wall and inner wall; and fastening said cover plate on a step of said escalator.

* * * * *